US005601218A

United States Patent [19]

Takenaka

[11] Patent Number: 5,601,218

[45] Date of Patent: Feb. 11, 1997

[54] FIXED-QUANTITY DRINK VENDING MACHINE

[75] Inventor: Katsumi Takenaka, Mie, Japan

[73] Assignee: Fuji Electric Co., Ltd., Kawasaki, Japan

[21] Appl. No.: 413,210

[22] Filed: Mar. 28, 1995

[30] Foreign Application Priority Data

Apr. 4, 1994 [JP] Japan ..... 6-065928
Aug. 10, 1994 [JP] Japan ..... 6-187973

[51] Int. Cl.[6] ..... B67D 5/10

[52] U.S. Cl. ..... 222/641; 222/129.1

[58] Field of Search ..... 222/30, 63, 641, 222/129.1

[56] References Cited

U.S. PATENT DOCUMENTS 4,890,774 1/1990 Poore ..... 222/640
4,979,641 12/1990 Turner ..... 222/641 X
5,062,555 11/1991 Whigham et al. ..... 222/641
5,129,548 7/1992 Wisniewski ..... 222/641 X

FOREIGN PATENT DOCUMENTS

WO83/04447 12/1983 WIPO .
WO92/08671 5/1992 WIPO .

*Primary Examiner*—Andres Kashnikow
*Assistant Examiner*—Kenneth Bomberg
*Attorney, Agent, or Firm*—Kanesaka & Takeuchi

[57] ABSTRACT

A drink vending machine for providing fixed amounts of drinks is basically formed of a sales amount memory device for memorizing amounts of drinks to be sold as an opening duration of an ejection valve; a valve controller for opening the ejection valve by operation of one of the drink sales buttons; and a mode setting device for changing a mode to a setting mode for setting amounts of the drinks to be sold. The vending machine further includes a drink sales halt device, a timer and a sales amount registration device. The drink sales halt device stops ejection of the drink while the drink is ejecting from the ejecting valve by actuation of the sales button in the setting mode. In the setting mode, the timer counts the opening duration of the ejection valve from a time the sales button is pushed to a time the drink sales halt device is actuated. The sales amount registration device stores the counted opening duration of the ejection valve, which is used as the amount of the drink to be sold in response to operation of the sales button in a sales mode.

5 Claims, 10 Drawing Sheets

FIXED-QUANTITY DRINK VENDING MACHINE

BACKGROUND OF THE INVENTION AND RELATED ART STATEMENT

The present invention relates to a fixed-quantity drink vending machine for selling a specified amount of drink.

In a conventional fixed-quantity drink vending machine, an amount of drink to be ejected into a cup is memorized in advance in the machine as sales data according to the size of the cup and a type of drink. Drink ejection systems in such machines have different performances even if the machines are of the same type. Thus, the amount of drink to be sold must be reset to an appropriate value for each machine prior to the actual drink sale. A sales amount adjustment device has been conventionally used to adjust the amount of drink to be sold or the opening duration of drink ejection valves.

When using the sales amount adjustment device, however, adjustment and test sale must be repeated until the amount of drink to be sold reaches a desired value. This requires a large amount of time and labor, and the drink is wastefully ejected.

In addition, for some types of drinks, the amount of drink ejected at the time when the opening duration of the drink election valve is adjusted and set by repeating ejections sometimes differs from the amount of the drink continuously elected by pressing a drink sales button once in an actual sale. This is due to variations in the amount of drink ejected immediately after the ejection has been started, and it occurs particularly in the case of drinks under gas pressure. FIG. 10 shows the example, wherein the initial ejecting amount is different from the amount continuously ejected.

It is an object of the invention to provide a fixed-quantity drink vending machine, which allows an amount of drink ejected into a cup during adjustment to be registered as an amount of drink to be actually sold.

SUMMARY OF THE INVENTION

In a first aspect of the invention, as shown in FIG. 1, a fixed-quantity drink vending machine comprises drink sales buttons A for selling drinks; a sales amount storage or memory device B for storing the amounts of respective types of drinks to be sold as the opening durations of the corresponding drink ejection valves; and a drink valve controller C for opening the drink ejection valve for the duration corresponding to the operation of a drink sales button A. The vending machine further includes mode setting means D for shifting a mode for setting an amount of drink to be sold; drink sales halt means E for, in the setting mode, halting the sale of the drink which has been initiated by the operation of the drink sales button A; drink sales addition means F for, in the setting mode, providing an additional sale of the drink after the initial sale of the drink by the operation of the drink sales button A has been completed; a timer G for, in the setting mode, counting the opening duration of the drink ejection valve; and sales amount registration means H for storing the counted opening durations of the drink election valve as the amount of the drink to be sold in response to the operation of the drink sales button A.

In a second aspect of the invention, as shown in FIG. 2, the fixed-quantity drink vending machine according to the first aspect of the invention includes valve opening duration correction means I for correcting the amount of the drink to be ejected according to the opening durations of the drink ejection valve in a single drink ejection operation performed by the drink sales button A, the drink sales halt means E, and the drink sales addition means F.

In a third aspect of the invention, as shown in FIG. 3, a fixed-quantity drink vending machine comprises drink sales buttons A for selling drinks, and a sales amount storage or memory device B for storing the amounts of the respective types of the drinks to be sold as the opening durations of the corresponding drink ejection valves. The vending machine further includes mode setting means D for shifting a mode for setting an amount of drink to be sold; drink sales halt means E for, in the setting mode, halting the sale of the drink which has been initiated by the operation of the drink sales button A; a timer G for, in the setting mode, counting the opening duration of the drink ejection valve; sales amount registration means H for storing the counted opening duration of the drink ejection valve as the amount of the drink to be sold in response to the operation of the drink sales button A; and a drink valve controller C for, in a drink sale, opening the drink ejection valve for the valve opening duration corresponding to the operation of the drink sales button A, and, in the setting mode, continuously opening the valve for the drink sales button A.

In the first aspect of the invention, to set the amount of the drink to be sold, the mode setting means D is used for the machine to enter into the setting mode.

A drink sales button A is then pressed to read from the sales amount storage means B the opening time, i.e. t5 seconds, of the drink ejection valve that corresponds to the amount of the drink to be sold, i.e. Qm1, in response to the drink sales button A. If the drink sales halt means E is not operated, the drink ejection valve is opened for the opening duration, i.e. t5 seconds, to dispense the drink into a cup.

Even if the valve is opened for t5 seconds, a specified amount Qm1 of the drink is not necessarily sold because each drink ejection system has different performance, as described above. The operator thus operates the machine as follows while watching the drink ejected into the cup.

If a specified amount Qm1 of the drink is dispensed before t5 seconds have passed, for example in t4 seconds, the drink sales halt means E is operated at this point. This operation causes the drink ejection valve to close to end the sale of the drink. At this time, the timer G has counted t4 seconds as the opening duration of the drink ejection valve. The sales amount registration means H is then operated to register t4 seconds as the sales amount of this drink. This amount is registered as an update in the sales amount storage means B or registered in another storage means.

If the amount of the drink ejected does not reach the specified value Qm1 after t5 seconds have passed, the drink sales addition means F is turned on to add the drink. After a specified amount of the drink has been dispensed, the drink sales addition means F is turned off. If the drink sales addition means F has been turned on for, for example t1 seconds, the timer G counts the total opening duration of the drink ejection valve, that is, (t5+t1) seconds, which is then registered as the amount of the drink to be sold.

In the second aspect of the invention, the operation until the timer G counts the opening duration of the drink ejection valve is the same as in the first aspect, so the description is omitted.

On the other hand, since the amount of the drink ejected varies immediately after ejection of the drink has been initiated as described above, if the valve opening duration counted by the timer G is used as the amount of the drink to be sold, it may not agree with the amount of the drink actually sold.

The valve opening duration correction means I corrects the valve opening duration according to an increment in the amount of the drink ejected immediately after ejection has been initiated based on the amount of the drink to be ejected, which is determined by the valve opening duration counted by the timer G, and the characteristics of the drink and ejection system performance. The corrected opening duration of the drink ejection valve is accumulatively registered in the sales amount registration means H as the amount of the drink to be sold.

This invention is suitable to apply to the case where the drink is subject to variations in an ejection amount immediately after the ejection is initiated, and ejection and stop operations must be repeated for setting the amount.

In the third aspect of the invention the operation until the timer G counts the opening duration of the drink ejection valve is the same as in the first aspect of the invention, so the description is omitted.

In the first aspect of the invention, when a drink sales button A is pressed in the setting mode, the corresponding drink ejection valve is opened for the duration corresponding to the specified amount of the drink to be ejected, in order to eject that amount of the drink into a cup. In the third aspect, however, in the setting mode, the drink controller C operates so that the drink corresponding to the drink sales button A is continuously ejected until the drink sales halt means E is operated.

When the operator visually confirms that the amount of the drink ejected has reached a specified value, the operator halts the ejection by operating the drink sales halt means E. By this time, the timer G has counted the opening duration of the drink ejection valve, as in the first aspect of the invention.

The sales amount registration means H is then operated to register the counted valve opening duration as the sales amount of this drink in the sales amount storage means B. When the setting mode shifts to the drink sales status, the drink ejection valve is opened for the duration as stored in the sales amount storage means B to sell the set amount of the drink, by pressing the drink sales button A, as in the first aspect of the invention.

DETAILED DESCRIPTION OF PREFERRED EMBODIMENTS

Figure 1:
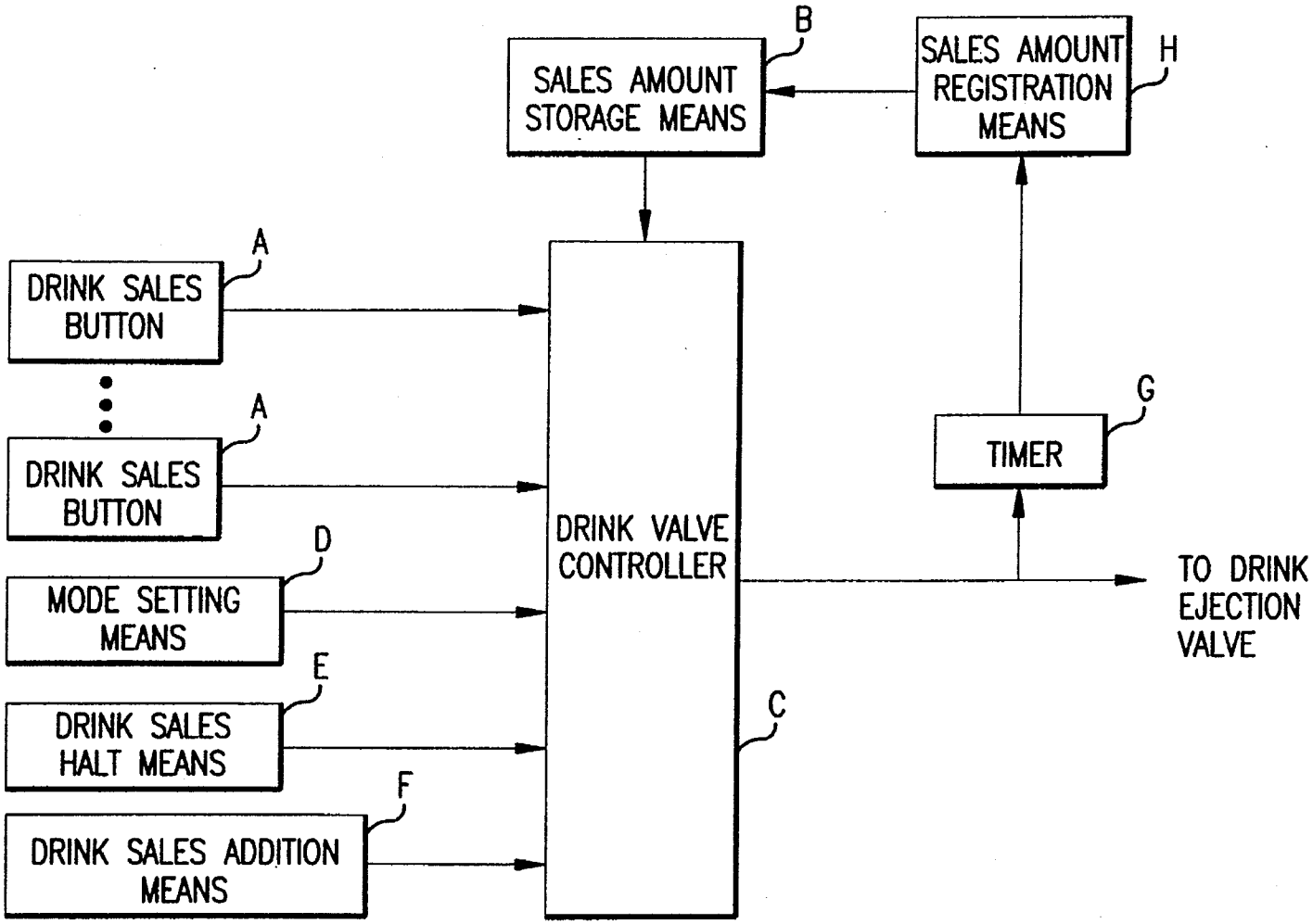
FIG. 1 shows a block diagram for a fixed quantity drink vending machine according to a first aspect of the invention.
Figure 2:
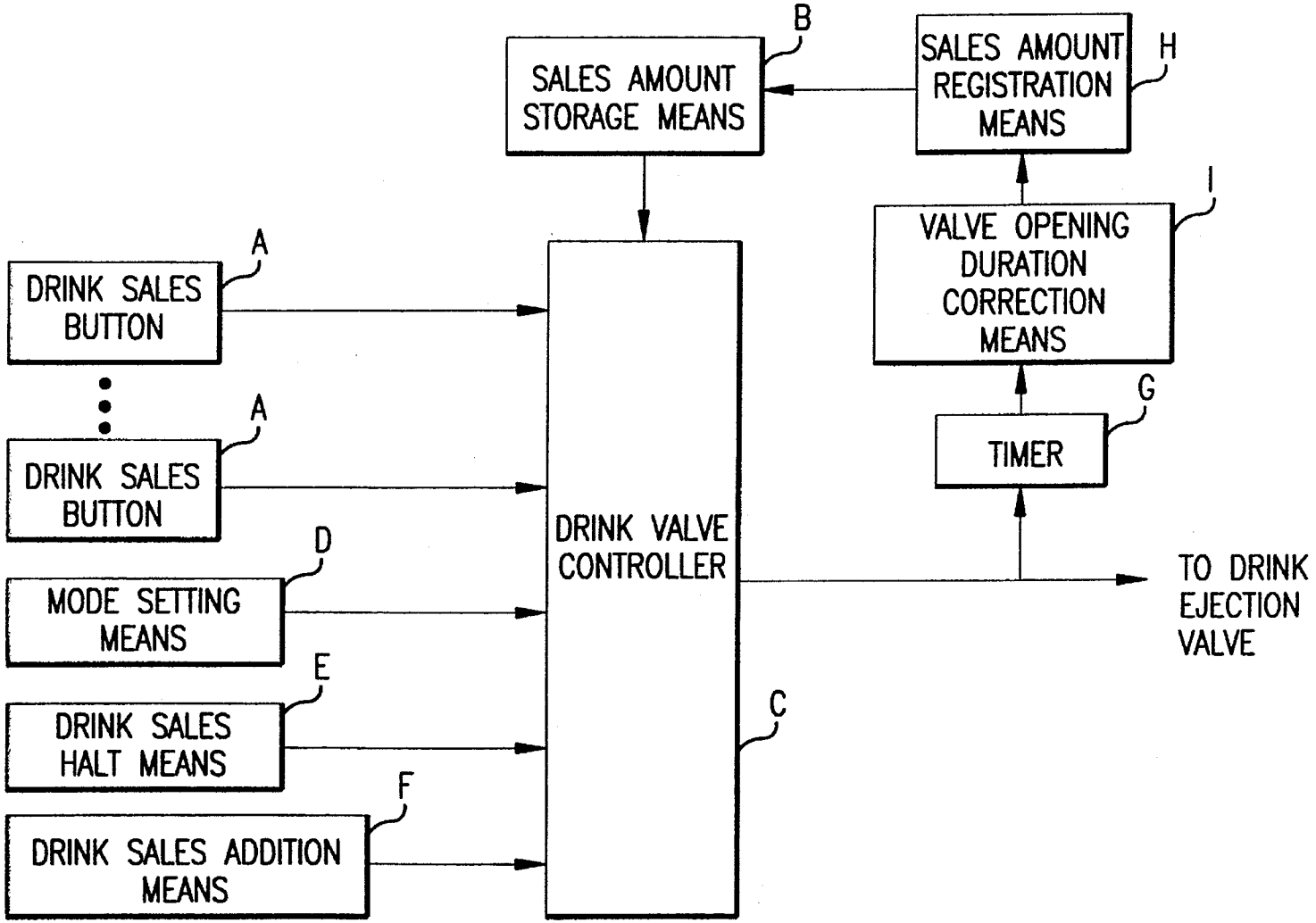
FIG. 2 shows a block diagram for a fixed quantity drink vending machine according to a second aspect of the invention.
Figure 3:
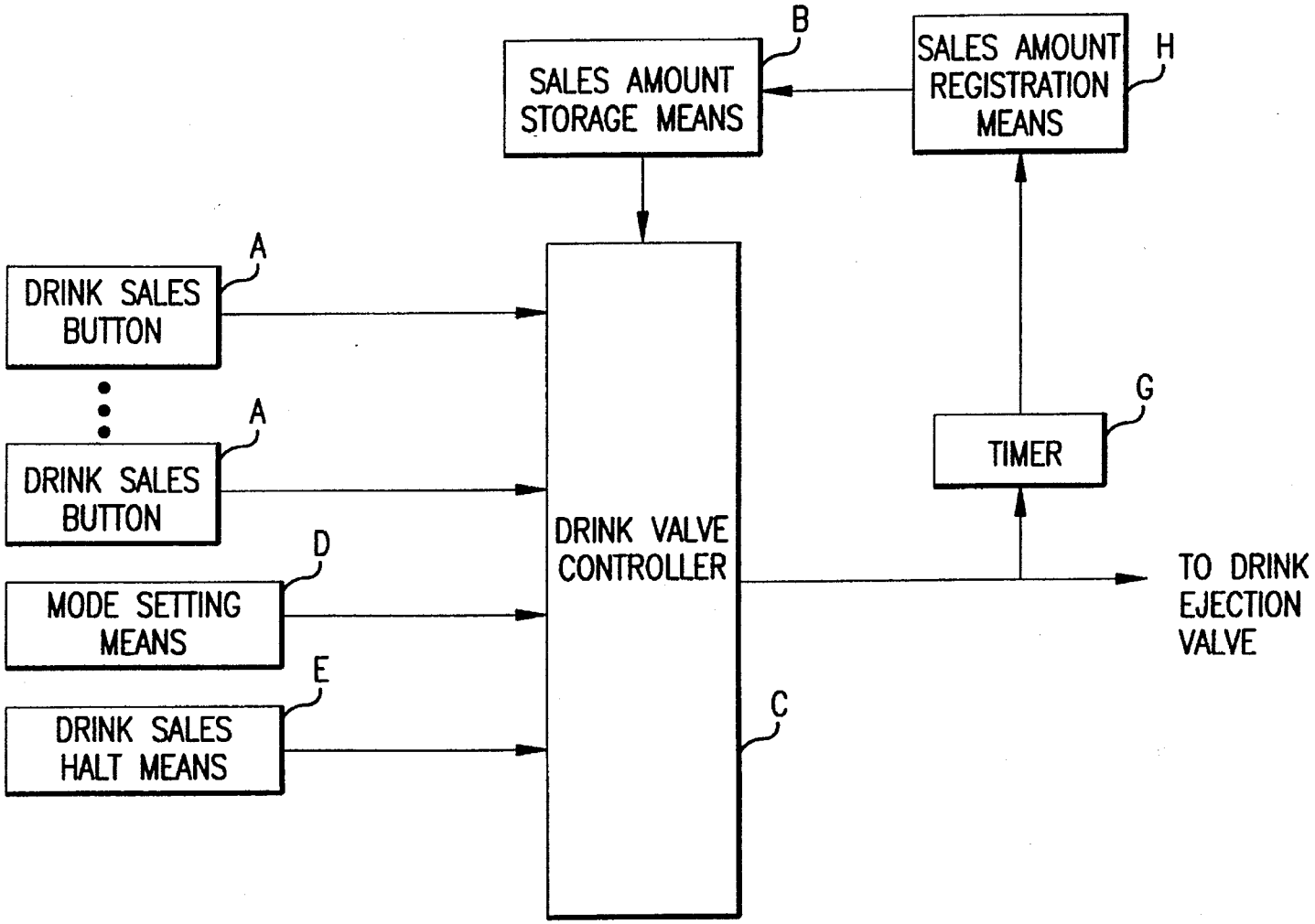
FIG. 3 shows a block diagram for a fixed quantity drink vending machine according to a third aspect of the invention.
Figure 4:
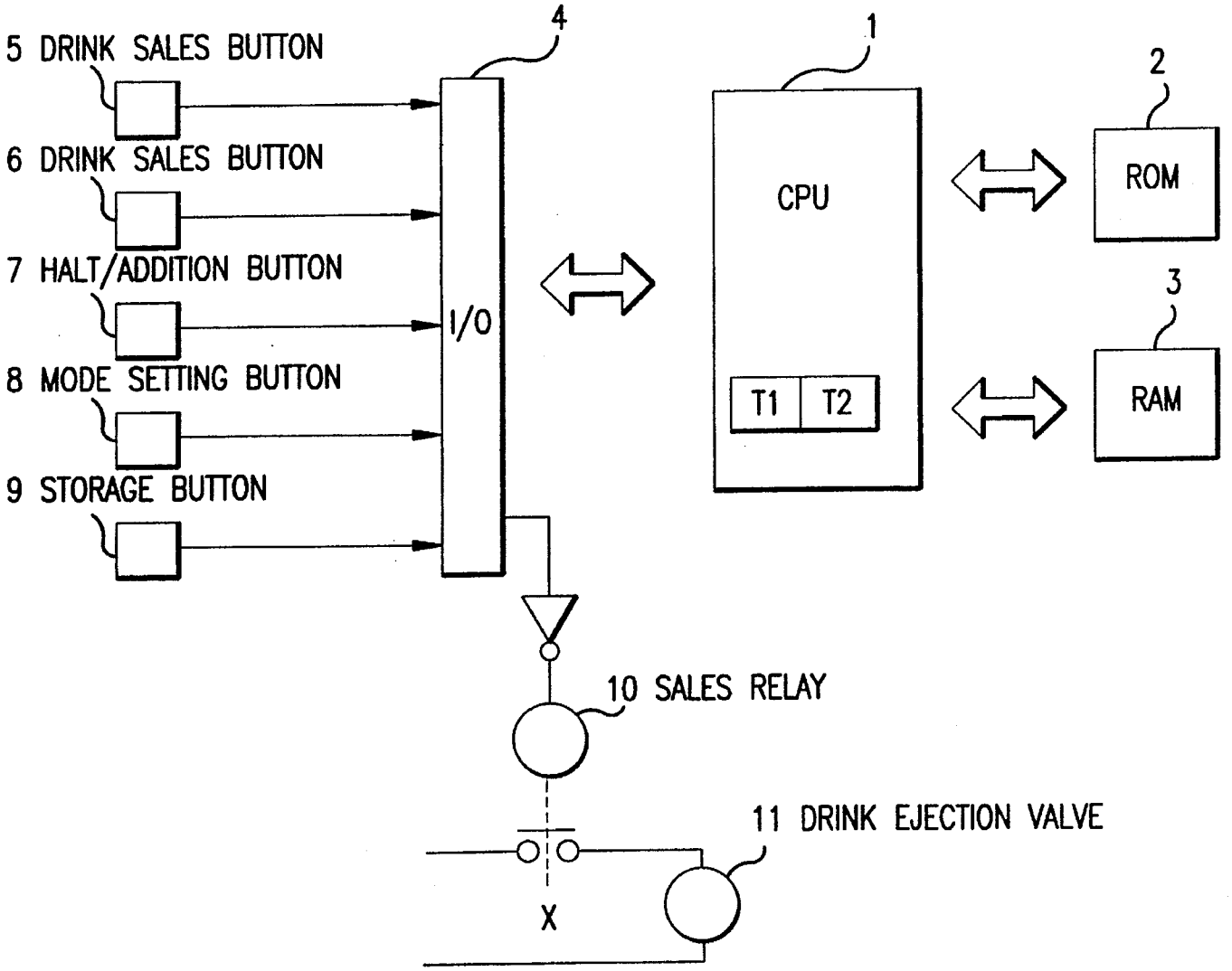
FIG. 4 is a block diagram showing the structure of the fixed quantity drink vending machine of the first aspect of the invention.

FIG. 4 is a block diagram for showing a first aspect of the invention. Reference numeral 1 designates a CPU for controlling the overall system; 2 is a ROM for storing a control program for the CPU 1; 3 is a RAM for storing sales amounts for respective drinks specified as opening durations for respective drink ejection valves 11; and 4 is an I/O section for the following equipments.

Reference numerals 5 and 6 designate drink sales buttons. Reference numeral 7 designates a halt/addition button for halting the sale of the drink when pressed after the drink sales button 5 or 6 has pushed to initiate the sale, and for providing an additional sale when pressed after the initial sale has been completed. Reference numeral 8 is a mode setting button for shifting to a mode for setting an appropriate sales amount for each drink, and 9 is a storage button for storing in the RAM 3 the total durations that the drink is actually dispensed by pressing the buttons 5 or 6, and 7, that is, the total opening durations of the drink ejection valve 11, as the sales amount of that drink.

Reference numeral 10 designates a sales relay, and the drink ejection valve 11 is driven via a contact X of the sales relay 10.

The CPU 1 includes a sales duration counting timer T1 for counting the valve opening duration, i.e. amount of the drink to be sold, stored in the RAM 3, and an actual sales duration counting timer T2 for counting the actual total opening durations of the drink ejection valve 11.

Figure 7:
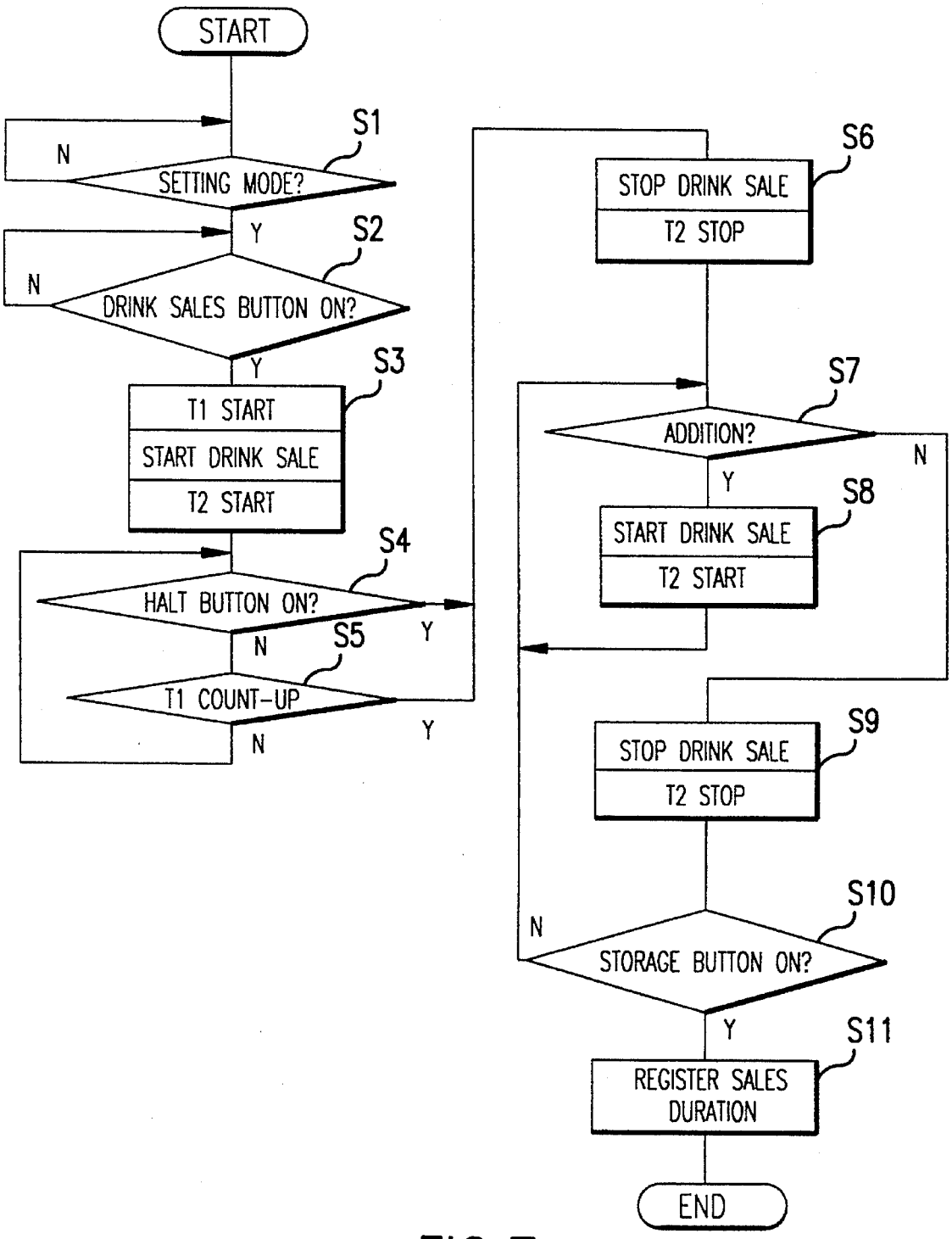
FIG. 7 is a flow chart showing the operation according to the first aspect of the invention shown in FIG. 1.

The operation of the machine with the above structure is described below with reference to the flow chart in FIG. 7.

When the mode setting button 8 is pressed, the process enters the setting mode for setting the amount of the drink to be sold, and proceeds from step S1 to step S2.

When a drink sales button, e.g. 5, is pressed, the process further proceeds to step S3, wherein the sales duration counting timer T1 starts counting, the drink ejection valve 11 is simultaneously opened to initiate a sale of the drink, and the actual sales duration counting timer T2 also starts counting.

Assume that the amount of the drink initially set for the drink sales button 5 is 150 ml, and that the corresponding opening duration for the drink ejection valve is 5 seconds.

Then, it is determined at step S4 whether the halt/addition button 7 has been pressed, and at step S5 whether the timer T1 has counted 5 seconds for the valve opening duration.

When a specified amount of the drink has been dispensed into a cup before the specified 5 seconds have passed, e.g. 4 seconds, the operator can press the halt/addition button 7 at this point to allow the process to proceed from the step S4 to step S6. At step S6, when the sale of the drink is stopped, the timer T2 simultaneously stops counting. In this case, when the storage button 9 is pressed, the process proceeds from step S10 to sep S11 to register the value of 4 seconds counted by the timer T2 in the RAM 3 as the drink sales amount for the drink sales button 5.

Figure 5:
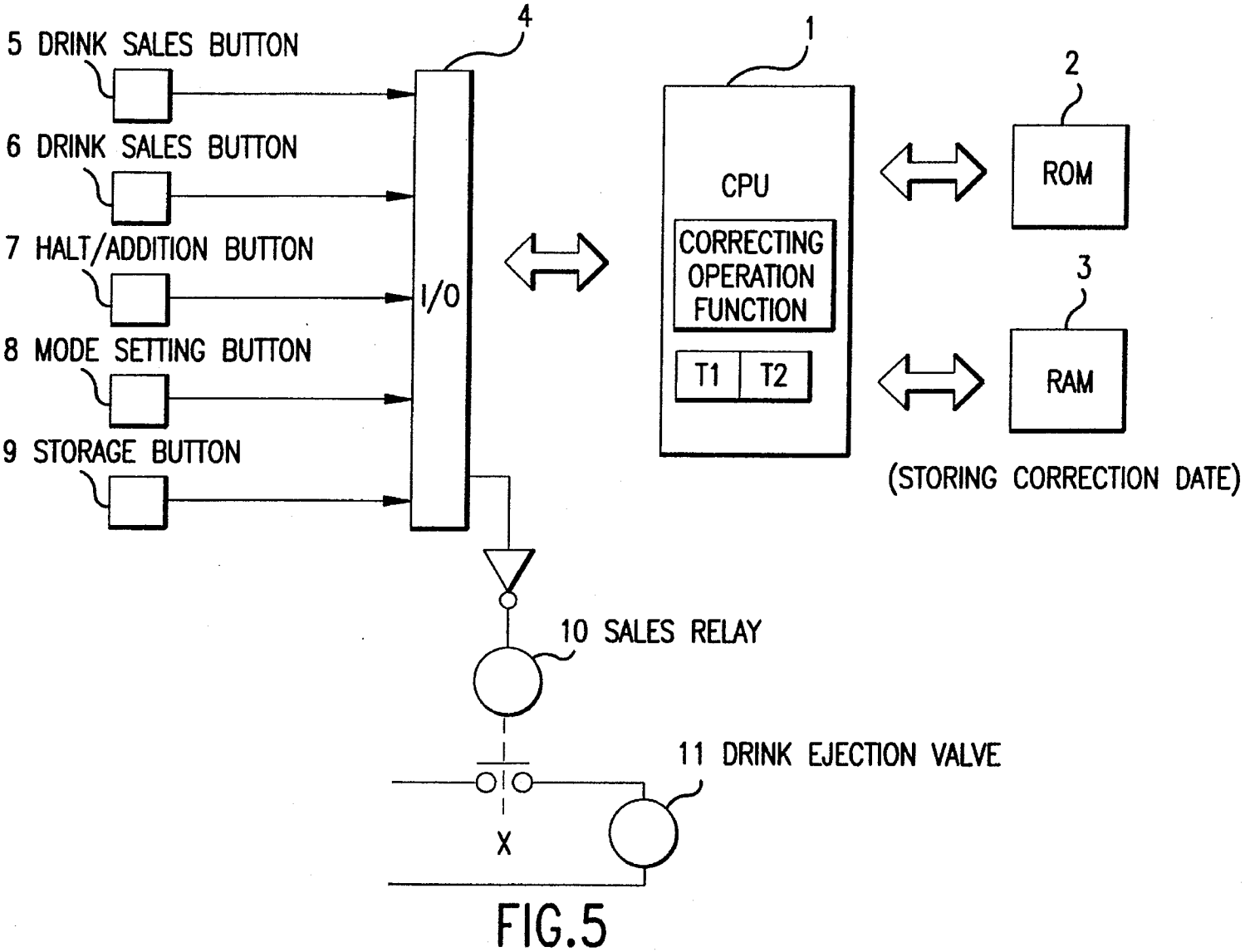
FIG. 5 is a block diagram showing the structure of the fixed quantity drink vending machine of the second aspect of the invention.

On the other hand, if a specified amount of the drink is not dispensed into the cup even after the specified sales duration of 5 seconds have passed, the timer T1 counts up at the step S5, and the process proceeds from the step S5 to the step S6. At the step S6, the sale of the drink is stopped, and the timer T2 simultaneously stops counting. When the halt/addition button 7 is then pressed to add the drink, the process proceeds from step S7 to step S8, where a sale of the drink is again initiated and the timer T2 simultaneously starts counting. If the operator confirms one second later that the specified amount of the drink has been dispensed into the cup, the operator pushes off the halt/addition button 7. The process then proceeds from the step S7 to step S9, where the sale of the drink is stopped and the timer T2 stops counting. When the storage button 9 is pressed, the process proceeds from the step S10 to the step S11 to register the value of (5+1) seconds counted by the timer T2 in the RAM 3 as the drink sales amount for the drink sales button 5. FIG. 5 is a block diagram of the second aspect of the invention. When comparing to the embodiment of the first aspect of the invention as shown in FIG. 4, this embodiment includes as valve opening duration correction means, a correction operation function in the CPU 1 and correction data in the RAM 3.

The operation of the machine with the above structure is described below with reference to the flow chart in FIG. 8.

Figure 8:
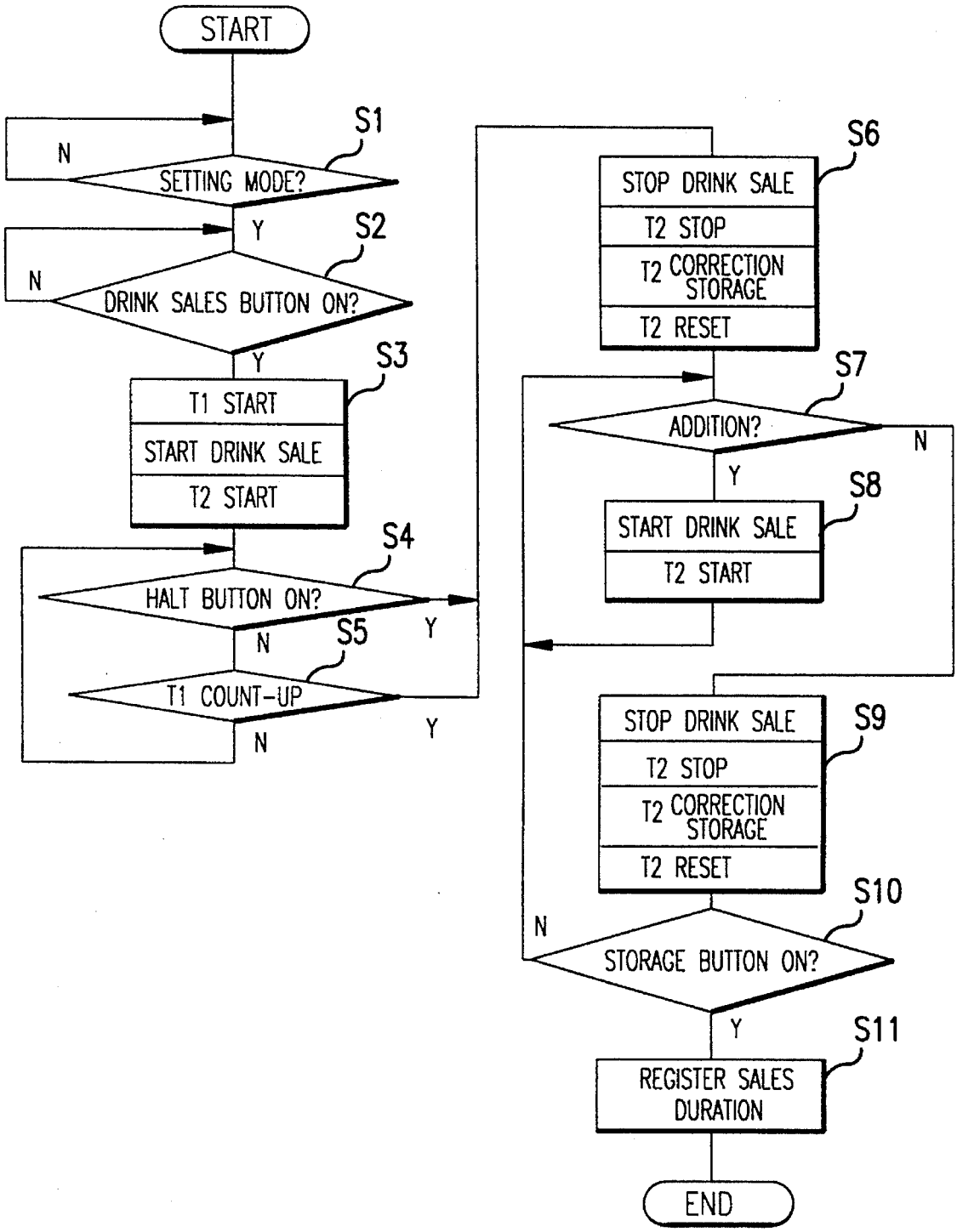
FIG. 8 is a flow chart showing the operation according to the second aspect of the invention shown in FIG. 2.

FIG. 8 is the same as the flow chart for the embodiment of the first aspect of the invention in FIG. 7 except the addition of steps after the steps S6 and S9 for correcting the actual opening duration of the drink ejection valve counted by the timer T2, storing the corrected value as a sales amount, and subsequently resetting the timer T2 after each drink ejection operation to correct and count the valve opening duration for each drink ejection operation. The other operation is the same as in the embodiment of the first aspect of the invention, so the description is omitted and the above additional step is described below.

That is, at the steps S6 and S9, the sale of drink is stopped and the timer T2 simultaneously stops counting. The duration counted by the timer T2 is then corrected as described below, the corrected duration is stored in the RAM 3, and the count of the timer T2 is reset. The process then proceeds to the next step.

When the storage button 9 is then pressed, the process proceeds from the step S10 to the step S11, where the total of the corrected valve opening durations counted by the timer T2 and accumulatively stored in the RAM 3 is registered in the RAM 3 as the sales amount corresponding to the sales button for the drink.

An example of correction data and correction operation in the above case is shown below.

Figure 10:
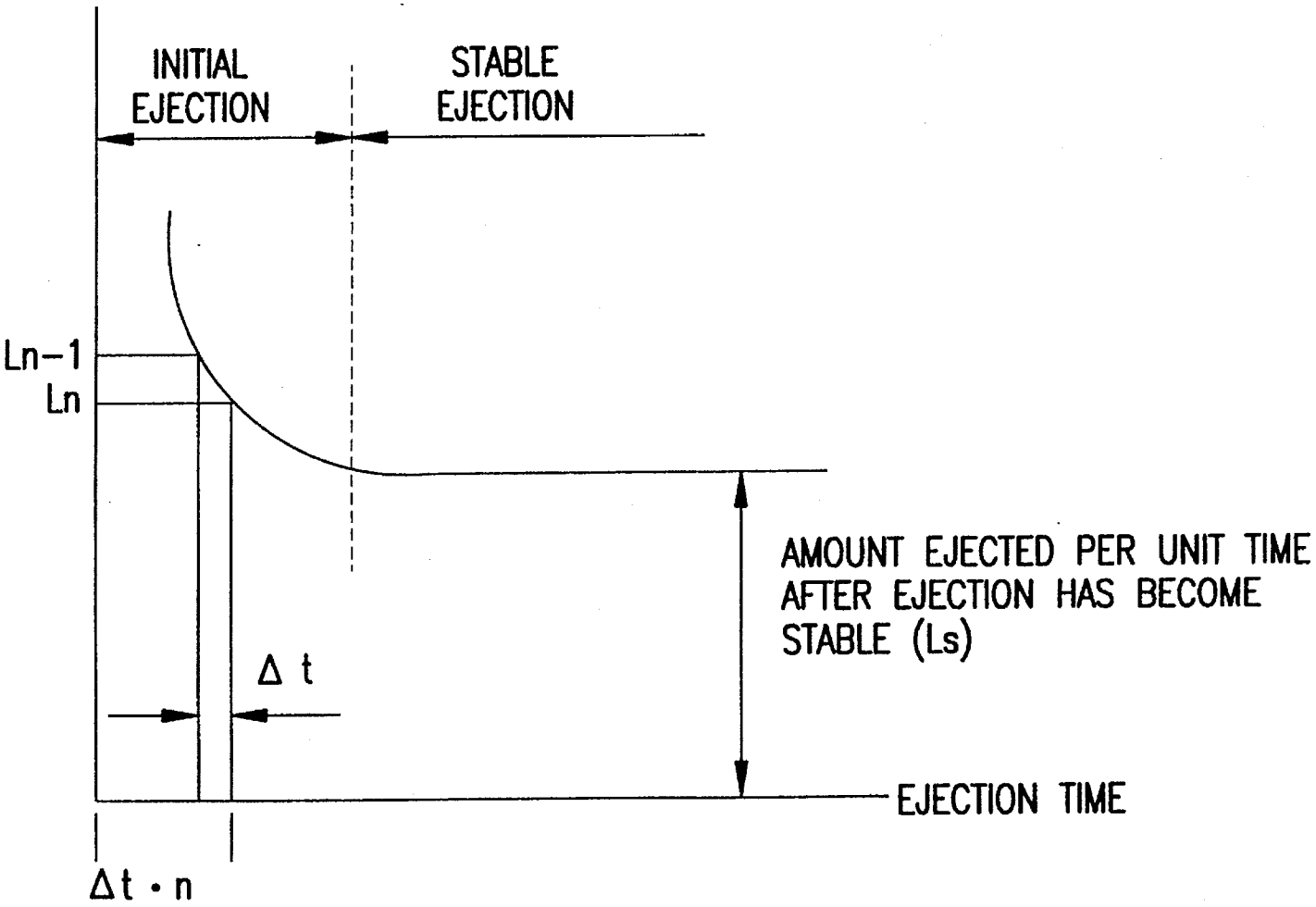
FIG. 10 is a graph showing the transition of the amount of drink ejected per unit time after a drink valve is opened.

First, the relationship between the ejection duration and the ejection amount is stored in the RAM 3 as data for correcting the amount of drink ejected in a sale by using a graph as shown in FIG. 10. If the counting interval of the timer for counting the opening duration of the drink ejection valve is, for example, 0.05 seconds, a table showing the amount of the drink to be ejected per unit time, that is, 0.05 seconds, is stored in the RAM 3.

The additional ejection is repeated until the drink sales amount reaches a specified value, wherein in each time, the ejection duration is multiplied by a correction factor $\Sigma Ln/(Ls \times n)$. The total accumulated value is the drink ejection set duration, for which a specified drink is to be ejected by pressing the drink sales button to continuously open the valve.

In the above expression, Ln is the amount of drink ejected for a unit time at the n-th ejection from the initial ejection (in this case, 0.05 sec., 0.10 sec., 0.15 sec.). This value is read from the stored table. That is, $\Sigma Ln$ is the sum of the accumulated amount of the drink ejected per unit time (in this case, 0.05 seconds). In addition, Ls is the amount of the drink ejected per unit time when the ejection duration has entered within a stable range.

The reason why correction can be executed according to this expression is as follows.

The counting time unit of the valve opening duration counting timer is represented as $\Delta t$ (in the above example, 0.05 seconds). Since the amount of the drink ejected for $\Delta t$ is the sum of the amounts of the drink ejected at the respective counting point of time, $(L1 \cdot \Delta t + L2 \cdot \Delta t + \ldots Ln \cdot \Delta t) = \Sigma Ln \cdot \Delta t$.

On the other hand, the amount of the drink ejected per unit time is Ls and the set duration is $\Delta t \cdot n$, when the valve is continuously opened to eject drink. Thus, if the correction factor is referred to as $\alpha$, the set value used for an actual drink sale is obtained by multiplying the product of above two values by $\alpha$. The following equation can thus be established.

$$\Sigma \cdot Ln\Delta t = \Delta t \cdot n \cdot Ls \cdot \alpha$$

$$\alpha = \Sigma Ln/(Ls \times n)$$

The equation can then be established, as described above.

Thus, this correction reduces the difference between the set amount of the ejected drink and the amount of drink ejected in the actual sale.

In this example, the data stored in the RAM 3 represents the relationship between the ejection duration and the amount of drink ejected per unit time. Only this relationship needs to be corrected when the condition or type of drink to be sold is changed or when the counting interval of the valve opening duration counting timer is changed. The correction factor must be calculated, however, for each drink ejection duration in the setting operation. The correction factor for each accumulated duration counted according to the counting interval of the timer may thus be stored instead of the above relationship. Although, in this embodiment, the amount of drink to be ejected per unit time (in this example, 0.05 seconds) is used, the duration after the initiation of ejection may be measured, and the amount of drink to be ejected which corresponds to that duration may be obtained from a table stored to correct it.

Figure 6:
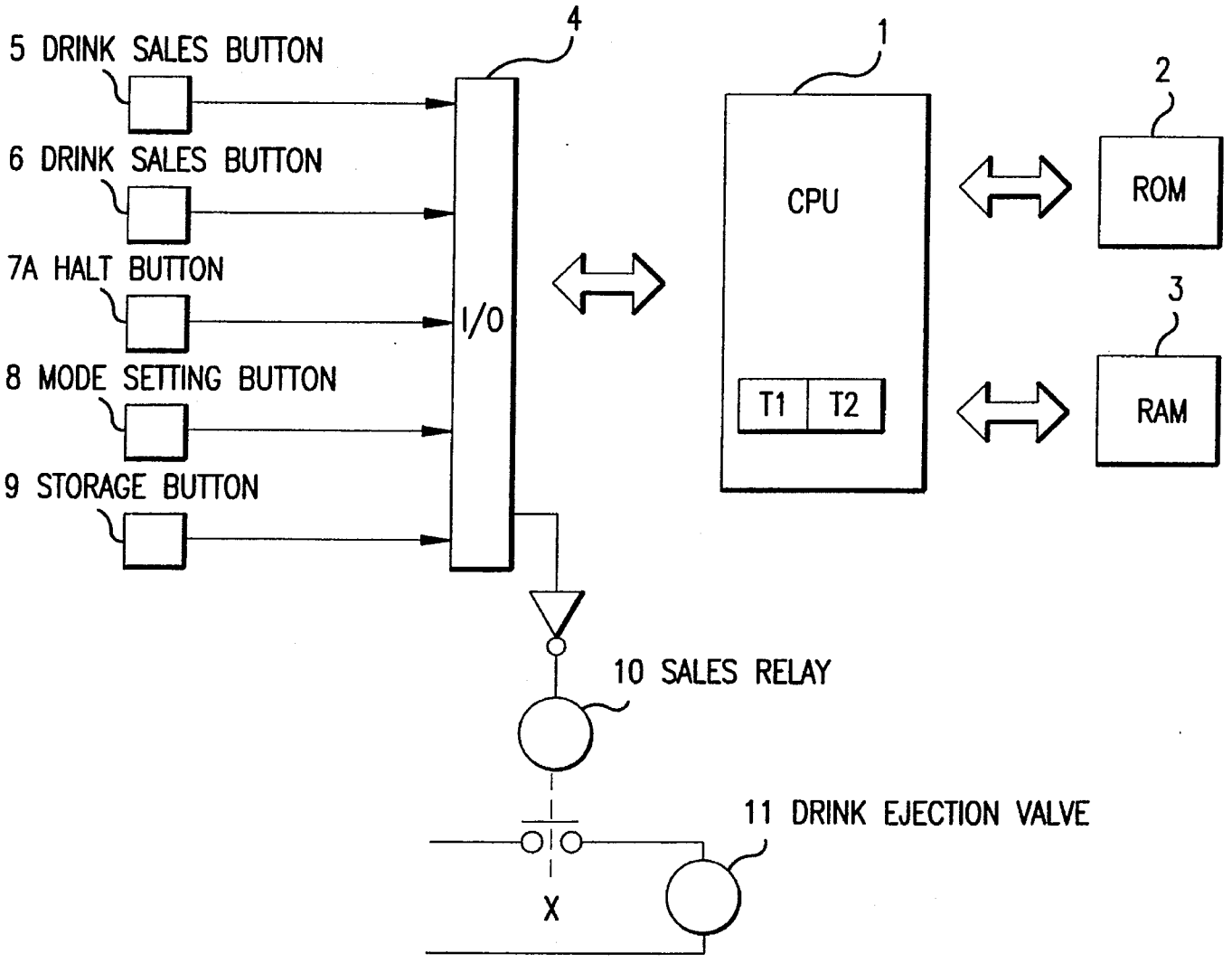
FIG. 6 is a block diagram showing the structure of the fixed quantity drink vending machine of the third aspect of the invention.

FIG. 6 is a block diagram of a third aspect of the invention. When comparing to the first aspect of the invention as shown in FIG. 4, the embodiment in this figure has no drink sales addition button for adding the sale of the drink after the initial sale activated by the drink sales button is completed. Instead, a halt button is shown as reference numeral 7A. The timer T1 is controlled so as not to operate in the setting mode.

Figure 9:
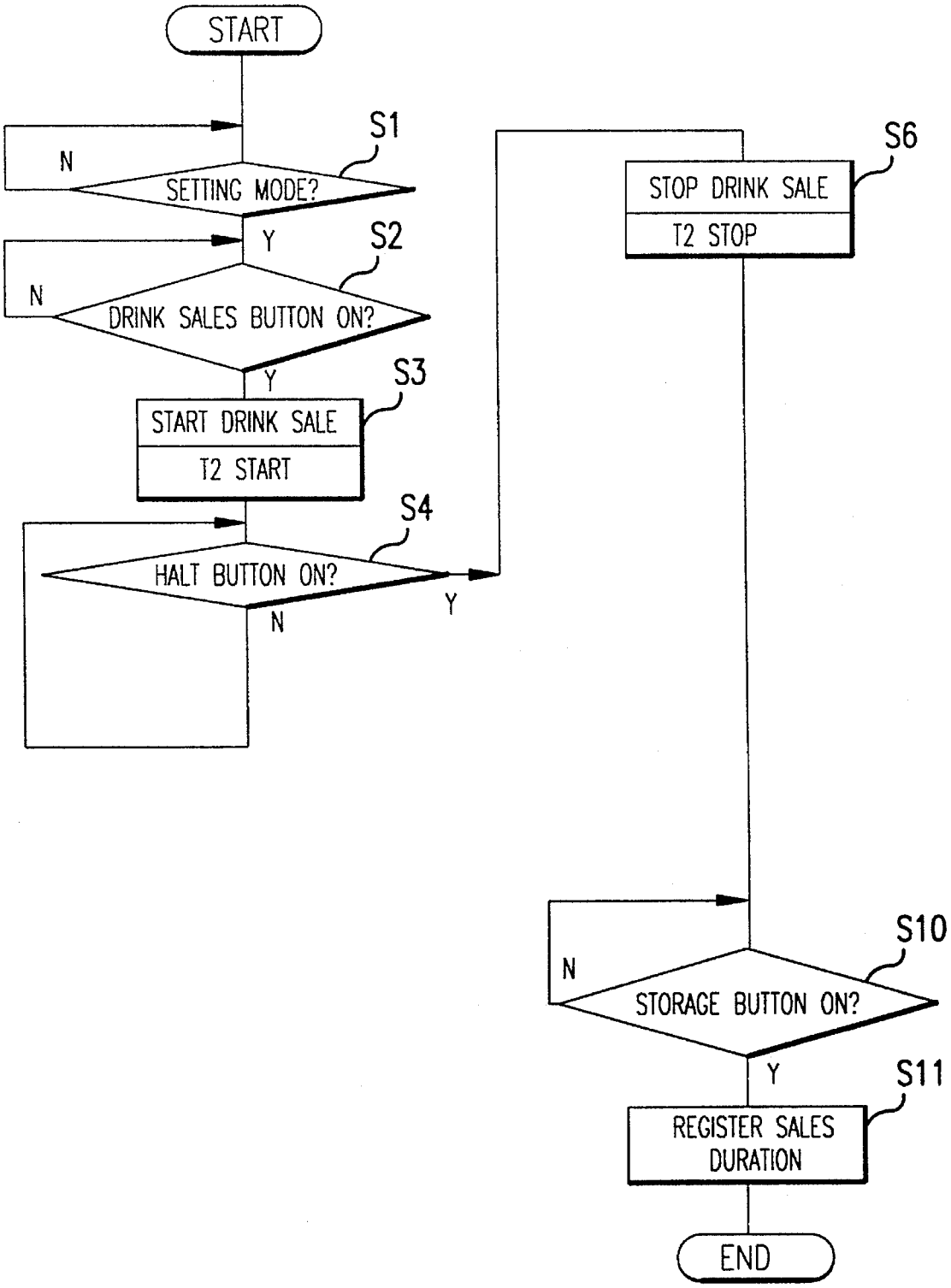
FIG. 9 is a flow chart showing the operation according to the third aspect of the invention shown in FIG. 3.

The operation of the machine with the above structure is described with reference to a flow chart in FIG. 9. When comparing to the flow chart of the embodiment shown in FIG. 7, the timer T1 in step S3, and steps S5, S7, S8 and S9 are excluded from this figure.

As in the first aspect of the invention, when the mode setting button 8 is pressed, the process enters into the setting mode for setting the amount of the drink to be sold, and proceeds from step S1 to step S2.

When a drink sales button, i.e. 5, is pressed, the process further proceeds to step S3. Unlike the first aspect of the invention, however, the sales duration counting timer T1 is not operated, and the drink ejection valve 11 is continuously opened to start dispensing drink. The actual sales duration counting timer T2 simultaneously starts counting, and the process then proceeds to step S4.

When the operator presses the halt button 7 visually confirming that a specified amount of the drink was ejected, the process proceeds from step S4 to step S6, where the sale of the drink is halted and the timer T2 stops counting.

When the storage button 9 is pressed on, the process proceeds from step S10 to step S11 to register the duration counted by the timer T2 in the RAM 3 as the sales amount for the drink sales button 5.

According to the first aspect of the invention, an appropriate sales amount can be set by a single sales operation to facilitate the setting operation and to minimize the amount of drink wastefully ejected, because, in such a setting operation, a specified amount of the drink is actually dispensed into a cup by halting the ejection or providing additional drink and the duration of this operation is registered as the sales amount for this drink.

According to the second aspect of the invention, not only the effect of the first aspect of the invention can be produced but also a predetermined amount of the drink can be automatically dispensed in an actual sale, because variations in the amount of the drink ejected immediately after the drink ejection valve is opened are corrected for the respective valve opening durations.

According to the third aspect of the invention, the appropriate amount of a drink to be sold can be set easily by a single operation because, in such a setting operation, the drink is continuously ejected by pressing the drink sales button, the ejection is halted when the amount of the drink ejected reaches a specified value, and this sales duration is registered as the sales amount of this drink.

What is claimed is:

1. A drink vending machine for providing fixed amounts of drinks through an ejection valve, comprising:

sales buttons for selling the drinks;

a sales amount memory device for memorizing the amounts of the drinks to be sold as an opening duration of the ejection valve;

a valve controller connected to the sales buttons and the sales amount memory device, said valve controller opening the ejection valve by operation of one of the sales buttons;

mode setting means connected to the valve controller for shifting a mode to a setting mode for setting amounts of the drinks to be sold;

drink sales halt means connected to the valve controller, said drink sales halt means, while the drink is ejecting from the ejecting valve by actuation of the sales button in the setting mode, halting the ejection of the drink when actuated;

a first timer connected to the valve controller, said first timer in the setting mode counting the opening duration of the ejection valve from a time the sales button is pushed to a time the drink sales halt means is actuated; and sales amount registration means connected to the sales amount memory device and the first timer, said sales amount registration means, in the setting mode, storing the counted opening duration of the ejection valve, said counted opening duration stored in the sales amount registration means being used as the amount of the drink to be sold in response to operation of the sales button in a sales mode.

2. A drink vending machine according to claim 1, wherein said valve controller opens the ejection valve for a valve open time corresponding to the drink sales button, said vending machine further including addition means used in the setting mode for providing an additional amount of the drink after an initial setting of the drink by the operation of the sales button is completed.

3. A drink vending machine according to claim 2, further comprising a second timer connected to the addition means for counting an operation time of the addition means, said operation time being added to the valve open time and memorized in the sales amount registration means.

4. A drink vending machine according to claim 2, further comprising valve opening duration correction means for correcting an ejection amount according to the opening duration of the ejection valve in an ejection operation performed by the sales buttons, the halt means and the addition means, said corrected ejection amount being memorized in the sales amount registration means.

5. A drink vending machine according to claim 1, wherein said valve controller, in the sales mode, opens the ejection valve for a valve opening duration corresponding to the sales button, and, in the setting mode, continuously opens the valve corresponding to the drink sales button.

* * * * *